US006826816B2

(12) United States Patent
Emery et al.

(10) Patent No.: US 6,826,816 B2
(45) Date of Patent: Dec. 7, 2004

(54) MULTI-LAYER MULTI-DIMENSIONAL TRANSDUCER AND METHOD OF MANUFACTURE

(75) Inventors: Charles D. Emery, Renton, WA (US); Martina Vogt, Mercer Island, WA (US); Stephen C. Englund, Bellevue, WA (US)

(73) Assignee: Siemens Medical Solutions USA, Inc., Iselin, NJ (US)

( * ) Notice: Subject to any disclaimer, the term of this patent is extended or adjusted under 35 U.S.C. 154(b) by 87 days.

(21) Appl. No.: 10/246,141

(22) Filed: Sep. 18, 2002

(65) Prior Publication Data

US 2004/0049900 A1 Mar. 18, 2004

(51) Int. Cl.[7] ..... H04R 17/00

(52) U.S. Cl. ..... 29/25.35; 29/594; 29/595; 29/830; 29/831; 29/846; 29/593; 29/412; 29/417

(58) Field of Search ..... 29/25.35, 594, 29/595, 830, 831, 846, 593, 412, 417; 310/334, 340, 339, 336, 344, 337, 348, 346; 367/140, 155, 153

(56) References Cited

U.S. PATENT DOCUMENTS

| | | | |
|---|---|---|---|
| 5,548,564 | A | 8/1996 | Smith |
| 5,834,880 | A | 11/1998 | Venkataramani et al. |
| 5,844,349 | A | 12/1998 | Oakley et al. |
| 6,088,894 | A | 7/2000 | Oakley et al. |

*Primary Examiner*—Carl J. Arbes
*Assistant Examiner*—Tai Nguyen

(57) ABSTRACT

A method of manufacturing multiple dimension transducer arrays of multiple layer elements from modules is provided. A plurality of multiple layer strips are formed. The strips are separate, such as an elongated strip corresponding in size to one row of elements. Connections between the electrodes of various layers or separate connections from the various electrodes to a bottom of the strip are formed on the separate multiple layer strips. The separate strips are then aligned within a frame and bonded together. The resulting sheet of multiple layer transducer material is then diced to form elements. Due to the previous interconnection of electrodes, each element includes electrical connections for each of the layer electrodes, avoiding the need for vias or high aspect ratio sputtering.

12 Claims, 2 Drawing Sheets

MULTI-LAYER MULTI-DIMENSIONAL TRANSDUCER AND METHOD OF MANUFACTURE

BACKGROUND

The present invention relates to a method of manufacturing a multi dimensional transducer using multi-layer transducer ceramic. In particular, a method of manufacturing 1.25D, 1.5D, 1.75D and two-dimensional arrays with elements using multi-layer ceramic.

Multi-dimensional ultrasound arrays provide a large number of elements, which require a great number of electrical connections to the system. For multi-layer elements, an additional electrical connection within the element is required. Additional electrical connections are difficult for multi dimensional arrays. For a linear array, the electrodes of the various layers are easily accessible for sputtering to provide electrical interconnection to the system. For multi-dimensional arrays, the internal electrodes for elements internal to the array are not accessible. Furthermore, since the size of the element is significantly reduced compared to a conventional transducer, material imperfections or minor processing mistakes can render an element useless.

U.S. Pat. No. 5,548,564 discloses forming vias at the edges of elements for making signal and ground connections to various electrodes in a multi-layer element. Vias may be 50 to 150 micrometers in diameter or larger. Due to the fine pitch of two-dimensional or multi-dimensional array elements, such as 310 micrometers, the large vias limit the element size and deteriorate the performance of each element. One via may be shared along four elements to make ground and signal connections, but precise and accurate placement of the vias in alignment with the transducer material layers is difficult. The vias also waste transducer material. Using separate vias for signal connections and ground connections to avoid short circuiting may allow for very little variation or tolerance for the placement and size of the vias.

U.S. Pat. No. 5,834,880 uses high aspect ratio sputtering on the multi-layer elements of the multi dimensional array. To achieve reliable electrical connection to the internal layers, high aspect ratio sputtering may require an increased kerf width. Electrode material is sputtered within the kerfs for interconnecting electrodes from various layers. The sputtering is done for a front and back or top and bottom of the array separately, increasing the amount of handling of the transducer array. Increased handling may lead to decreased array performance. To allow the high aspect ratio sputtering, dicing cuts forming the kerfs are made through most but not all of the transducer material. The transducer material bridges between the elements weekly maintains interconnection of the array. Handling may break the connections, ruining the array. Dicing is also required to electrically separate the connections.

BRIEF SUMMARY

The present invention is defined by the following claims, and nothing in this section should be taken as limitation on those claims. By way of introduction, the preferred embodiments described below include a method of manufacturing multiple dimension transducer arrays of multiple layer elements. A plurality of multiple layer strips or modules are formed. The strips are separate, such as an elongated strip corresponding in size to one row of elements. Interconnections between the electrodes of various layers or separate connections from the various electrodes to a bottom of the strip are formed on the separate multiple layer strips. The separate strips are then aligned within a frame and bonded together. The resulting sheet of multiple layer transducer material is then diced to form elements. Due to the previous interconnection of electrodes, each element includes electrical connections for each of the layer electrodes, avoiding the need for vias or high aspect ratio sputtering.

Further aspects and advantages of this modular approach of the invention are discussed below in conjunction with the preferred embodiments.

BRIEF DESCRIPTION OF SEVERAL VIEWS OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Multi-layer strips or modules are formed and then placed in a fixture to make a multi-dimensional array. For example, each module corresponds to a row of elements, such as 25 mm long, 0.27 mm wide and 0.57 mm thick (e.g. three layers). Electrode connections for the electrodes of each layer are made on the modules while separate. The separate modules may then be independently tested for removing poor quality modules. Since the sides or edges connecting the top and bottom of the strips are fully exposed, sputtering or other methods for forming the electrical connections is easier, nor requiring vias or high aspect ratio sputtering. The strips are then placed in a mold at the pitch of the multi-dimensional array of elements. For example, 64 strips are placed adjacent to each other and each strip corresponds to a row of 64 elements. The strips are bonded together and then to a backing. After dicing, a 64×64 two-dimensional array of elements is formed where each element has multiple layers.

Figure 1:
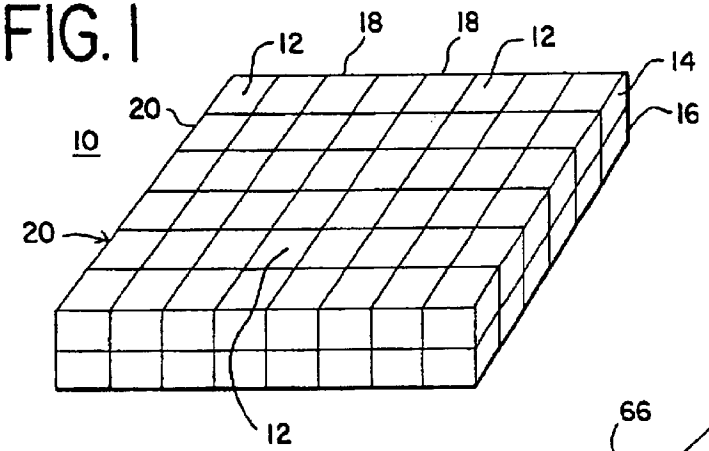
FIG. 1 is a perspective view of one embodiment of a multi-layer ceramic, multi-dimensional transducer.

FIG. 1 shows one embodiment of a multi-layer, multi-dimensional array 10. Each of the elements 12 includes two or more layers 14, 16. Each layer 14, 16 comprises transducer material, such as a ceramic, piezoelectric, substrate and membrane or other material for transducing between electrical and acoustical energy.

Each of the layers 14, 16 is separated at least partially by an electrode. An electrode may be provided on the top and bottom of each element 12 for independently or dependently providing signals to or from the layers 14, 16. While two layers 14, 16 are shown, three or more layers may be provided. In one embodiment, electrodes associated with every other layer 14, 16 are interconnected, such that one signal to or from a system channel connects to every other electrode and the other electrodes connect to ground. In alternative embodiments, each electrode associated with each layer 14, 16 independently connect to different system channels or ground. The electrical connections to the system channels or between electrodes of different layers 14, 16 extend along one or both sides of the elements 12 to a top or bottom of the element 12. An electrode on a top of each element 12 may be part of a common electrode connected to ground, so may not extend down the sides of the elements 12. In alternative embodiments, an electrode on the top of the element 12 is electrically connected to ground or the system channel by a conductor along the side of each element 12.

The transducer 10 includes a plurality of columns 18 and rows 20 of elements 12. The rows 20 extend along one dimension and the columns 18 extend along another dimension to form the multi dimensional array 10, such as an N×M array of elements where N and M are both great then one. The array 10 may be concave, convex or planar. Along a layer axis orthogonal to the rows 20 and columns 18 is the layer dimension. The layers 14, 16 are layered along the layer dimension. The layer dimension corresponds to a depth or range dimension.

The array 10 comprises a two-dimensional, 1.25D, 1.5D, 1.75D, 2D or other multi-dimensional array. For example, 1.5D, 1.25D, or 1.75D dimensional arrays have three or five rows 20 of a greater number of elements 12. The arrangement of elements 12 discussed above provide rectangular or square arrays 10. In alternative embodiments, an irregular pattern of elements 12 is provided, such as one intersecting column 18 of elements 12 with a row 20 of elements 12 as a "+" array. Other array configurations may be provided where more than one element 12 is provided along each of two dimensions at any part of the array 10.

Figure 2:
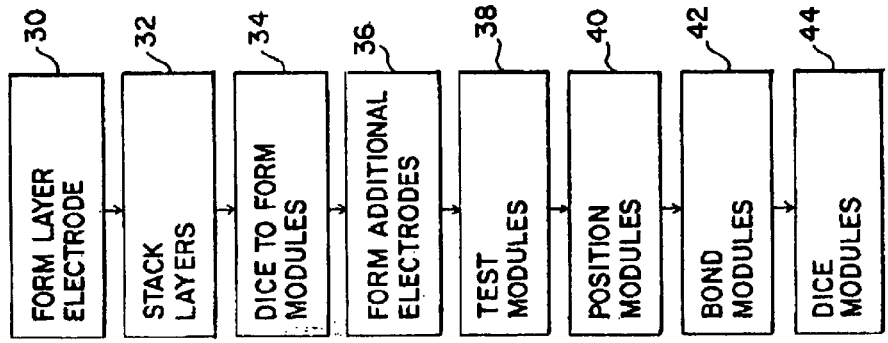
FIG. 2 is a flowchart diagram of one embodiment of a method of manufacturing multiple layer, multiple dimensional transducer arrays.

FIG. 2 is a flow chart of one embodiment of a method for manufacturing a multi-dimension, multi-layer transducer. In the embodiment of FIG. 2, the modules or elongated strips are formed as one device and then separated for electrical interconnection. In alternative embodiments, one or more of the elongated strips or modules is formed completely independent of other modules or elongated strips. Additional, different or fewer acts may be provided than shown in FIG. 2.

A sheet of transducer material, such as piezoelectric material is selected or formed. In one embodiment, the sheet of transducer material comprises green tape, but sintered piezoelectric material may be used. The transducer material is of a thickness for one layer of the multi-layer elements 12. For example, a 30 to 40 micron or thicker sheet is provided. The thickness is a function of the desired frequency of operation of the array 10. Holes are punched, etched or otherwise formed in the selected transducer material. The holes are used for later alignment of multiple layers.

In act 30, at least one layer electrode to be placed between two layers 14, 16 is formed on a selected sheet of transducer material. In one embodiment, the electrode is screen printed or deposited on the sheet of transducer material. In one embodiment, silver palladium is screen printed to form the electrodes, but platinum, or other combinations of conductive materials may be used for the electrode. Using optical, pegs or other alignment, the screen printing or electrode deposition is properly positioned on the sheet of transducer material. Electrode gaps are cut or masked across the sheet for an electrode pattern corresponding to different modules or elongated strips. For example, gaps between electrodes associated with each module to be cut from the sheet provide electrical isolation of the electrode away from an edge of the module. Where more than two layers are to be used, additional layer electrodes are formed on additional sheets of transducer material. The electrodes to be on the top or bottom of each element 12 may also be formed on sheets of transducer material at this time, but may alternatively be formed after the modules are separated or later bonded.

In act 32, the sheets of transducer material with any associated layer electrodes (electrodes for positioning between two sheets of transducer material) are stacked. Using previously punched or formed holes, the plurality of layers are aligned for stacking. Any number of layers may be stacked. For example, nine layers are provided by stacking 18 sheets of green tape that are 42 micrometers thick each. Two sheets of green tape form each layer, but only one or three or more sheets may be used to form each layer. After stacking, the layer electrode at least partially separates two layers. For example, the layer electrode separates all but a thin longitudinal strip for each of the eventual modules. The thin strip provides electrical isolation from the layer electrode to one of two externally exposed sides of each module after separation of the modules.

The stacked layers are laminated in an isostatic or uniform pressure process. Lamination at varying pressures may also be provided. The rims or edges of the laminated layers may be cut or ground so that the layered sheets have a desired shape, such as square or rectangular. In the green tape embodiment, organic solvents are removed by debindering. The sheets are allowed to air dry or are elevated in temperature to 300 to 400 degrees to debinder the organic solvents at atmosphere pressure or other pressures. The layered sheets are then sintered. In one embodiment, the layers are heated at 1130° C. for two hours, but other temperatures and other time periods may be used. In the embodiment where previously sintered sheets are stacked, the sintering, debindering, and lamination are performed prior to stacking. The resulting layer sheets of transducer material correspond generally to the size and shape of the desired transducer array 10 after dicing and molding. Additional length and width may be provided to account for dicing operations and desired sampling or elements center-to-center distance.

Figure 3:
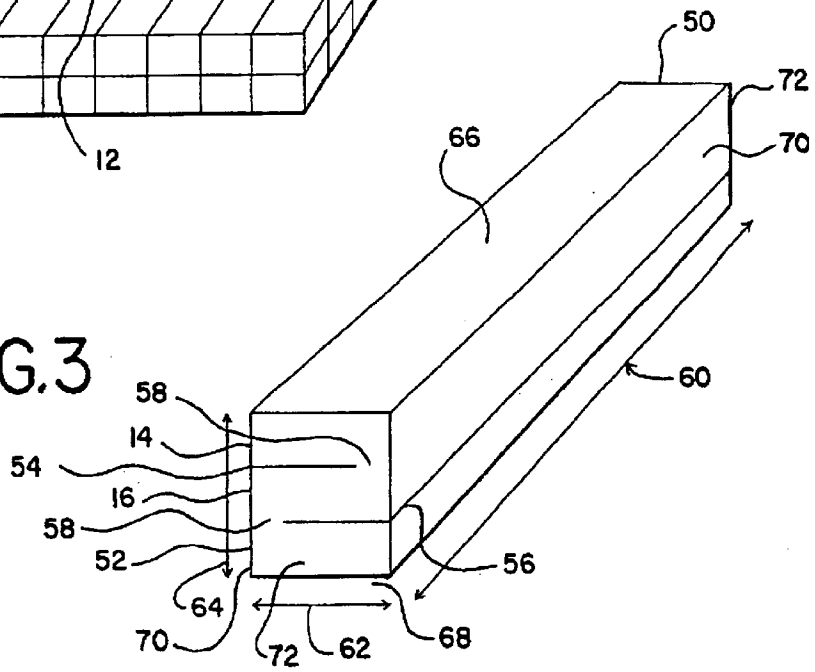
FIG. 3 is a perspective view of one embodiment of a multi-layer ceramic elongated strip or module.

In act 34, the layered sheets of transducer material are diced to separate the various modules or elongated strips. The stacked layers are diced into at least two elongated strips. Each of the separated elongated strips or modules formed includes at least two layers separated at least partially by a layer electrode. For example, FIG. 3 shows one embodiment of an elongated strip or module 50 with three layers 14, 16 and 52 of transducer material. Two of the layers 14, 16 are separated by a layer electrode 54. Another layer electrode 56 separates two other layers 16, 52. Based on the patterning of the layer electrodes 54, 56, a gap 58 is provided so that the electrodes 54, 56 avoid exposure on one side of the module or elongated strip 50. The electrodes 54, 56 are exposed on at least one side for electrical connection to ground or system channels, but may be exposed on more than one side. The gaps 58 as shown are not necessarily to scale so are likely narrower, but may be larger.

Each of the plurality of elongated modules 50 formed from the layered sheet has a length corresponding to at least two elements 12. The length is indicated by an arrow 60 representing one dimension of the eventual array 10. In one embodiment, the length of each module 50 corresponds to an extent of the array along one dimension, but lesser or greater lengths may be provided. For example, each module may correspond in length to a single element. The width of each module 50 corresponds to the width of a single element. The width is indicated by the arrow 62. In alternative embodiments, the width of the modules 50 correspond to two or more elements. The width corresponding to one or two elements allows for exposure of the electrodes 54 and 56 on a side of the module 50 without the need for vias or high aspect ratio sputtering for electrical connection of the electrodes 54, 56. As used herein, elongated is a longer length then width. The depth of the modules 50 corresponds to the thickness of the plurality of layers 14, 16, 52 or the thickness of the elements 12. The arrow 64 shows the thickness along the layer dimension. While each layer is shown as having an equal thickness, layers with different thicknesses may be provided along the layer dimension 64. In one embodiment, each module 50 has a length of 25 millimeters, a width of 0.27 millimeters and a thickness of 0.57 millimeters. The length corresponds to 64 elements. The width corresponds to a single element width and length. The thickness corresponds to three layers. The thickness of each layer may be the same or different than for other layers. Where each module 50 is cut from a layered sheet of transducer material that is about 25 mm×25 mm or longer, 64 modules 50 or elongated strips are formed from one sheet. The 64 modules may be used for making a 64×64 element array 10. In alternative embodiments, some modules 50 are formed from different layered sheets. In yet other alternative embodiments, different lengths, widths and/or numbers of modules may be provided for forming arrays of the same or different number of elements. For example, modules for a 1.5D array of three or five rows of 64 or more elements are provided from a single rectangular layered sheet of transducer material.

Each module or elongated strip 50 includes a top 66, a bottom 68, two elongated sides 70 and ends 72. The layer electrodes 54 and 56 are exposed on one or more of the elongated sides 70 and/or on the ends 72, but may be exposed on both ends 72 and/or both elongated sides 70. For electrical connection of the electrodes 54, 56, each module 50 is cleaned, such as placing the module in a holder and exposing the module 50 to solvents or acids. The elongated sides 70 are polished using a polishing pad or grinder under optical or other control. The module 50 may be measured or examined to assure no surface flaws, exposure of the electrodes 54, 56 and proper dimensions. In preparation for forming electrical contacts, the modules 50 are exposed to solvent or thermal annealing.

In act 36 of FIG. 2, a side electrode is formed on at least one side of the modules. The side electrodes comprise a signal trace, a sheet of electrode material, a wire, or other electrical conductor. The side electrode electrically connects one of the top and bottom electrodes to the layer electrodes 54 and 56. For example, an electrode on the top 66 of the module 50 is electrically connected to the layer electrode 56 on one side 70. An electrode on the bottom 68 is electrically connected on an opposite side 70 to another of the layer electrodes 54. The electrical connections on the sides 70 result in every other electrode along the layer dimension being connected to either ground or a same system channel. In alternative embodiments, the electrodes formed on the side 70 are isolated from other side electrodes so that each electrode on the top, the layer electrode 54, 56 and/or an electrode on the bottom 68 are electrically independent and have electrical connections exposed near the bottom 68 of the module 50.

By forming the side electrodes or additional electrode material on the exposed sides 70 of the modules 50 when the modules 50 are separate, electrical connections to the internal layer electrodes 54, 56 are more easily made through sputtering. Other techniques than sputtering may be used for forming the side electrodes or additional electrode material. Signal lines or other electrical connections for each of the electrodes for each of the elements 12 are formed on the separate modules or elongated strips 50. Easy access is provided to each electrode needed for eventual connection to ground or the system channels.

The entire side 70 may be metallized using masking or dicing to avoid undesired electrical contact between electrode layers. In alternative embodiments, a more patterned metallization is provided where the pattern repeats across the side 70 of the module 50 as a function of the number of elements 12 to be formed from the module 50. A holding device using pegs or other precise positioning devices may be used for sputtering the additional electrode material onto the module 50. Any unwanted sputtered metal or additional electrode material is removed by grinding or etching, or is avoided by using masking or laser application.

The transducer material of the module 50 is then poled. In one embodiment, the poling is performed independently for each of the modules 50. In alternative embodiments, the modules 50 are poled together. The module 50 is aligned so that the polarization is applied along the layer dimension 64 from the top to the bottom or from the bottom to the top. In one embodiment, the modules 50 are placed in a holding device and oriented relative to an electric field or magnetic field in a mineral oil bath. The electric field is applied to pole the transducer material.

In act 38, the separate modules are tested prior to being combined into the multi-dimensional array. For example, the capacitance, resonance, impedance or other acoustical or electrical characteristic of each module 50 is tested. Testing each of the modules 50 separately identifies modules 50 that do not meet specific performance parameters. Disposing an individual module is cheaper and more effective than disposing an entire array. Separate testing minimizes the amount of waste and increases the likelihood that the eventual multi-dimensional, multi-layer array 10 includes elements 12 with sufficient transduction operation.

Figure 4:
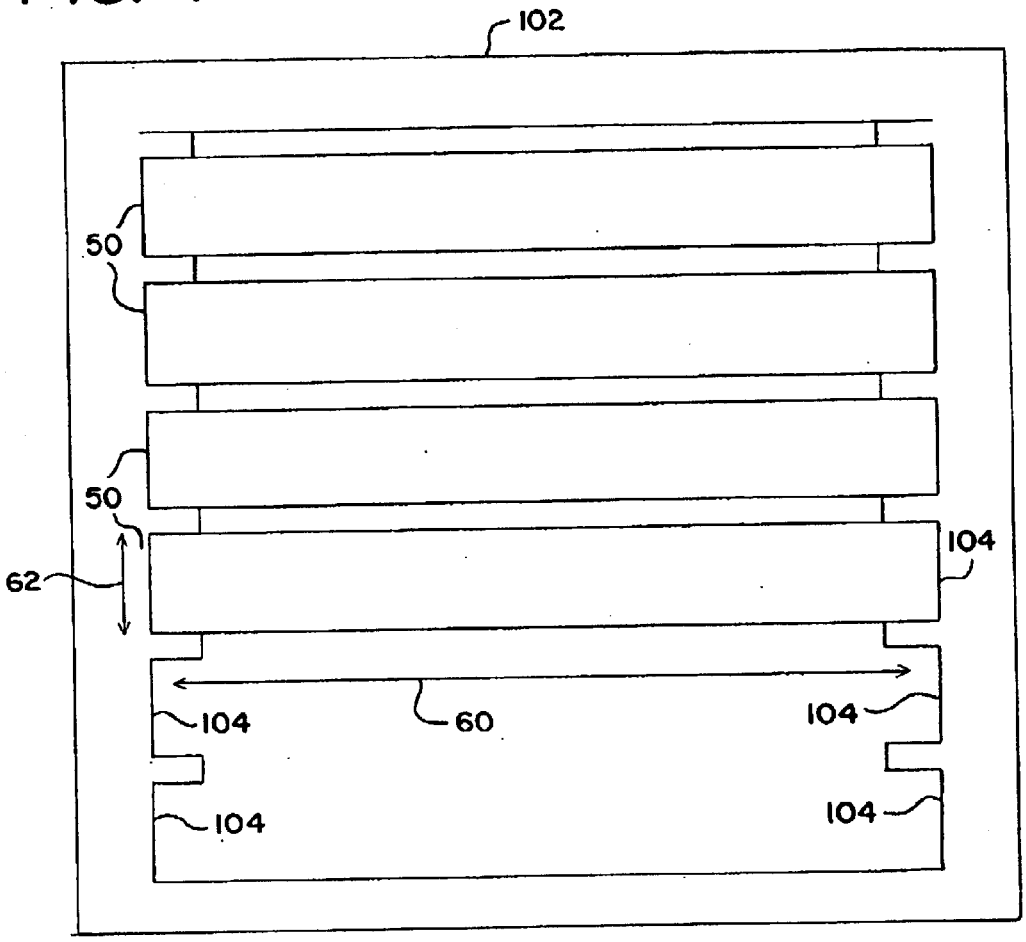
FIG. 4 is a top view of a frame for aligning a plurality of elongated multiple layer strips.
Figure 5:
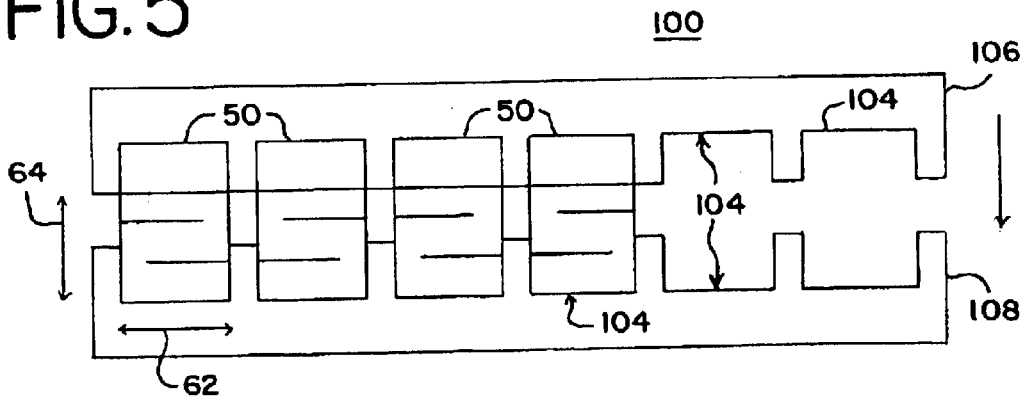
FIG. 5 is a side view of one embodiment of an alternative frame for aligning the plurality of multiple layer elongated strips.

In act 40 of FIG. 2, the modules or elongated strips 50 are positioned relative to other modules or elongated strips 50 in a frame. FIGS. 4 and 5 show two different types of frames 100 and 102. The frames 100 and 102 comprise graphite, silicon, metallic, or other materials for positioning modules 50 relative to other modules as aligned for use in the array 10. In one embodiment, the frames 100, 102 comprise silicon micromachined structures or silicon structures manufactured using masking, deposition and etching to provide precisely aligned grooves 104 or other key structures for holding the modules 50. In an alternative embodiment, a machined graphite mold provides the grooves 104. Lega processes using a cyclotron, precision molding, Keen methodology for forming the frames 102, 100 and associated grooves 104 or other processes may be used. Each of the frames 100, 102 is sized to hold all or a subset of the modules 50 for forming the two-dimensional array. In the embodiment discussed above using 64 modules 50, 64 pairs of grooves 104 are provided. The pairs of grooves 104 extend along one dimension of the multi-dimensional array 10.

The frame 102 of FIG. 4 shows an embodiment where the notches 104 hold the ends 72 and sides 70 of the modules 50 for positioning. Protrusions, ledges or other structures may be provided for orienting the modules 50 in a proper position along the layer dimension 64. The frame 100 of FIG. 5 shows separate top and bottom frames 106 and 108. The notches 104 of the top and bottom frames 106 and 108 align the modules using the top 66, the bottom 68, the ends 72 and the sides 70. In alternative embodiments, one or both of the top and bottom frames 106 and 108 aligns the modules 50 using only the top bottom and sides 66, 68 and 70 of the modules 50. Other frames using pegs, grooves, strings or other positioning structures may be used.

In act 42, the modules 50 are bonded adjacent to each other. For example, a binding medium (e.g. epoxy or other bonding agent) is poured into the frames 102, 100 or between the modules 50 to bond the modules 50 together. Due to the positioning in the frames 100, 102, the modules 50 are potted or bonded. The bonded modules have a depth corresponding to the thickness of the separate modules, a length corresponding to the length of the separate modules and a width corresponding to the sum of the widths of the bonded modules. For example, where each module or elongated strip 50 corresponds to a single element width and 64 modules are bonded together, the resulting bonded modules have a substantially 64 element width. Substantially is used to account for the kerf distance or distance between each of the modules 50 for keying or holding the modules 50. In one embodiment, the modules 50 are separated by a kerf width or a lesser width, but a greater distance may be provided. The bonded modules are bonded along one dimension, such as the width dimension, but may also be bonded along a length dimension to form a longer array 100. The length and width dimensions define a plane associated with a face of the transducer array that is orthogonal to the layer dimension 64.

The frames 100, 102 are removed from the bonded modules 50. For example, graphite frames 100, 102 are ground, edged or lapped off. In one alternative embodiment, the upper frame 106 of the frame 100 of FIG. 5 is machined or ground to provide a desired thickness to operate as a matching layer. In yet another alternative embodiment, the lower frame 108 of the frame 100 of FIG. 5 is maintained as a backing block or matching layer, such as where the lower frame 108 comprises an acoustically attenuative material.

The electrodes of the bonded modules 50 are connected to the system channels or ground connections. For example, a flexible circuit connects to a bottom of the bonded modules 50. The flexible circuit is glued or bonded such that signal traces connect with the separate or electrically independent electrodes. The flexible circuit may allow for a fully or sparsely sampled multi-dimensional array. In alternative embodiments, vertical connectors through a backing block or substrate are connected for electrical contact with the electrodes. In yet other alternative embodiments, a diced silver epoxy bond to the bottom of the bonded modules 50 provides further electrical connection to the electrodes.

The flexible circuit and bonded modules 50 are connected with a backing block. A ground electrode may be formed or deposited over the top of the bonded modules 50. Matching layers, lens layers and other transducer materials may be further provided.

After mounting the bonded modules 50 to a backing, such as a backing block, the bonded modules 50 are diced in act 44 of FIG. 2. The bonded modules 50 are diced along the width dimension 62 to form separate elements 12. The dicing acoustically and electrically separates the elements 12 from adjacent elements along the same module 50 or length dimension. As a result of the dicing, each module 50 is associated with a row of elements 12. Adjacent modules provide adjacent rows of acoustically and electrically separate elements 12. The epoxy or other bonding agent between the modules 50 acoustically and electrically isolates the elements 12 along the width dimension. After dicing to form separate elements 12, the multi-layer, multi-dimensional array 10 is further processed to form an ultrasound probe for acoustically scanning targets in a two-dimensional plane or for three-dimensional imaging.

In alternative methods of manufacturing, strips of green tape or other transducer material are used to separately form the module 50. The strips of green tape are laminated together as layers to form a single module 50. Other alternatives are also possible, such as using now known or later developed transducer processes for implementing any one of the steps discussed above.

Using the methods of manufacture discussed herein, a multi-layer, multi-dimensional transducer array 10 with acoustic and electrical separation between elements 12 is provided. A transducer material bridge, such associated with high aspect ratio sputtering, is not provided, but may be. The performance of the elements 12 is not jeopardized by vias. Layer electrodes are easily screen printed or otherwise deposited. The layer electrodes are then electronically connected by simple sputtering or other electrode forming processes on the sides of the modules 50.

Different thicknesses of dicing blades may be used for the different dicing operations, such as dicing with a first thickness for separating the modules 50. The dicing for separating the modules 50 is done with a thickness in a relation to an electrode pattern or screen printed pattern of the layer electrodes. Other dicing thicknesses may be provided for dicing to form or separate the elements 12.

While the invention has been described above by reference to various embodiments, it should be understood that many changes and modifications can be made without departing from the scope of the invention. For example, any number of layers or elements may be provided.

It is therefore intended that the foregoing detailed description be understood as an illustration of the presently preferred embodiments of the invention, and not as a definition of the invention. It is only the following claims, including all equivalents, that are intended to define the scope of this invention.

What is claimed is:

1. A method of manufacturing a multi-dimensional, multi-layered transducer array, the method comprising:

(a) forming a first module including at least two layers of transducer material at least partially separated by a first electrode;

(b) forming a second module including at least two layers of transducer material at least partially separated by a second electrode; and (c) bonding the first module adjacent the second module, the first module separate from the second module prior to bonding.

2. The method of claim 1 wherein (a) and (b) comprise:

(i) forming at least one electrode between the at least two layers, the at least one electrode corresponding to the first and second electrodes;

(ii) stacking the at least two layers; and (iii) separating the first module from the second module prior to said act of bonding.

3. The method of claim 2 further comprising:

(d) forming a side electrode on at least one side of the first module, the side electrode electrically connecting one of top and bottom electrodes of the first module to the first electrode between the at least two layers after said act of separating and before said act of bonding.

4. The method of claim 1 further comprising:

(d) forming a side electrode on at least one side of the first module, the side electrode electrically connecting one of top and bottom electrodes of the first module to the first electrode between the at least two layers wherein forming said side electrode occurs when the first module is separate from the second module.

5. The method of claim 1 wherein (a) and (b) comprise forming the first and second modules from green tape.

6. The method of claim 1 further comprising:

(d) positioning the first and second modules in a frame.

7. The method of claim 6 wherein (c) comprises placing a binding medium within the frame and between the first and second modules.

8. The method of claim 1 further comprising:

(d) separately testing the first and second modules prior to said act of bonding.

9. The method of claim 1 further comprising:

(d) dicing elements from the first and second modules after said act of bonding, the first and second modules corresponding to first and second adjacent rows of elements, respectively.

10. The method of claim 1 wherein the first and second module each have a first length corresponding to at least two elements, a first width corresponding to one element and a first depth corresponding to a thickness of the at least two layers and wherein said act of bonding comprises bonding the first and second modules such that the bonded first and second modules have a second depth that is substantially the same as the first depth, a second length that is substantially the same as the first length and a second width corresponding to two element widths.

11. The method of claim 1 further comprising:

(d) electrically interconnecting the first electrode with another electrode of the first module prior to said act of bonding but with the first module separate from the second module;

(e) electrically interconnecting the second electrode with another electrode of the second module prior to said act of bonding but with the second module separate from the first module; and (f) electrically connecting at least two electrodes from each of the first and second modules to a flexible circuit after said act of bonding.

12. The method of claim 1 further comprising:

(d) forming at least third, fourth, fifth and sixth modules each including at least two layers of transducer material at least partially separated by an electrode;

wherein said act of bonding comprising bonding the first, second, third, fourth, fifth and sixth modules along a first dimension, the first dimension one of two dimensions of the multi-dimensional, multi-layered transducer array, the two dimensions orthogonal to a layer dimension corresponding to the at least two layers.

* * * * *